US006363528B1

(12) United States Patent
Cyr

(10) Patent No.: US 6,363,528 B1
(45) Date of Patent: Apr. 2, 2002

(54) PROTECTIVE MASK WITH THROAT GUARD FOR PHYSICAL GAMES

(75) Inventor: Raymond Cyr, Duvernay (CA)

(73) Assignee: Leader Industries, Inc., Boucherville (CA)

( * ) Notice: Subject to any disclaimer, the term of this patent is extended or adjusted under 35 U.S.C. 154(b) by 0 days.

(21) Appl. No.: 09/500,737

(22) Filed: Feb. 9, 2000

(51) Int. Cl.[7] ..... A42B 3/18; A41D 13/00
(52) U.S. Cl. ..... 2/9; 2/424; 2/468
(58) Field of Search ..... 2/8, 9, 422, 424, 2/425, 468

(56) References Cited

U.S. PATENT DOCUMENTS 2,262,449 A * 11/1941 Buegeleisen ..... 2/12
2,750,592 A * 6/1956 Salminen ..... 2/8
2,817,087 A * 12/1957 Rush ..... 2/8
3,922,749 A * 12/1975 Castleman, Jr. et al. . 15/250.42
4,813,726 A * 3/1989 Ravinet ..... 292/241
RE34,699 E * 8/1994 Copeland et al. ..... 2/419
5,476,350 A * 12/1995 Kurtz et al. ..... 411/60
5,483,699 A * 1/1996 Pernicka et al. ..... 2/9
5,893,174 A * 4/1999 Primeau ..... 2/424

* cited by examiner

*Primary Examiner*—Michael A. Neas
(74) *Attorney, Agent, or Firm*—Fulbright & Jaworski

(57) ABSTRACT

A protective mask adapted to be worn by persons engaging in physical games comprises a body formed of rigid plastic material including a nose portion, a chin portion, a brow portion, opposite cheek portions and opposite side temple portions; an opening is provided between the brow portion and the nose portion and cheek portions to be covered by a flexible transparent lens. A throat guard is pivotally mounted to the opposite cheek portions and extends inwardly of the chin and cheek portions; the throat guard is pivotal between two vertical positions relative to the chin and cheek portions and includes a tongue that extends towards the inner face of the mask and is adapted to contact an inner lower edge area of the mask to define the lowermost vertical position; the throat guard further includes a lower outwardly projecting area to contact the lower edge of the mask to define the uppermost vertical position for the throat guard.

3 Claims, 2 Drawing Sheets

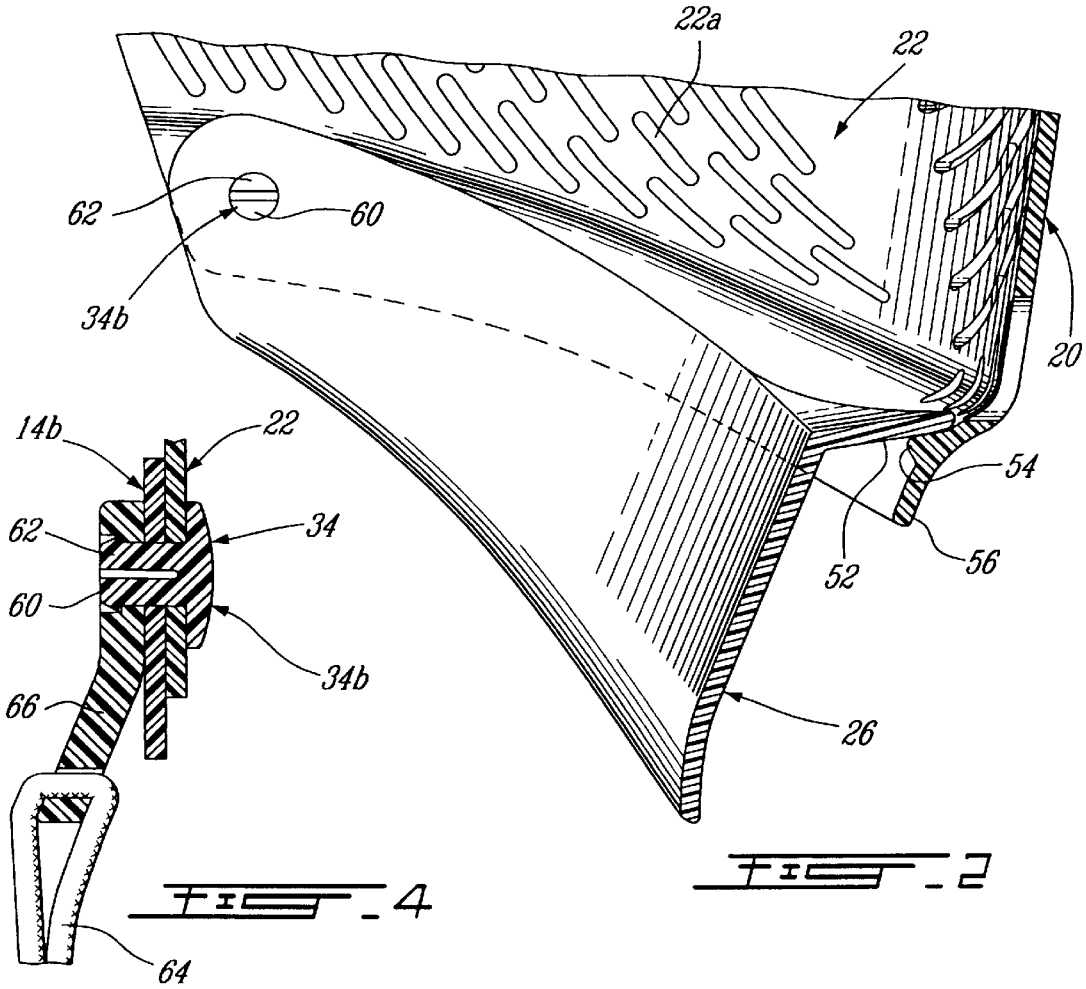
FIG. 4
FIG. 2
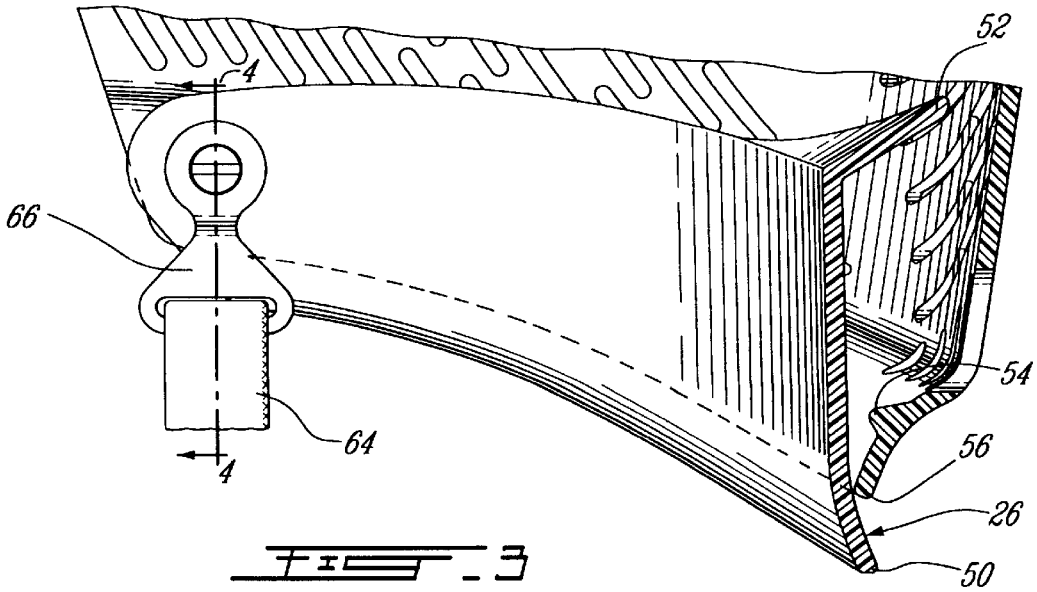
FIG. 3

PROTECTIVE MASK WITH THROAT GUARD FOR PHYSICAL GAMES

FIELD OF THE INVENTION

The present invention pertains to a protective mask adapted to be worn by persons engaging in physical games.

BACKGROUND OF THE INVENTION

Protective masks are typically used in an environment in which flying objects or projectiles may be present. Examples of such an environment are the game of ice hockey or the game of paint ball shooting where paint balls are projected onto players in order to display a hit. In order to protect the player's eyes, a lens assembly is used in association with a mask in order to fully cover the front face and sides of the player's head. In most cases, the lens is removable so that it can be easily replaced either for washing or for replacement should it become damaged.

It is also important to protect the throat of the player during such games and, especially in the game of ice hockey, a throat guard is mounted at the base of the mask to protect the player's throat. This throat guard cannot be fixedly mounted to the mask since it must follow vertical movements of the player's head during the game. In most face masks equipped with throat guards, the latter are usually mounted to the mask by means of strings or cords.

OBJECTS AND STATEMENT OF THE INVENTION

It is an object of the present invention to provide an improved protective mask to be worn by persons engaging in physical games with an improved throat guard pivotally mounted to the mask.

It is also an object of the present to provide a protective mask with a throat guard which can be easily removed from the face mask. This is achieved by a means of a quick snap-in engagement with or snap-out disengagement from the main body of the mask.

The present invention therefore relates to a protective mask adapted to be worn by a person engaging in physical games which comprises:

a main body formed of rigid plastic material including a nose portion, a chin portion, a brow portion, opposite cheek portions and opposite side temple portions to cover the front and sides of a person's head; the body displays an opening between the brow portion and the nose and cheek portions;

a transparent lens mounted to the body extending over the opening;

a throat guard pivotally mounted to the opposite cheek portions and inwardly of the chin and cheek portions; the throat guard is pivotable between two vertical portions relative to the chin and cheek portions; the throat guard has a tongue portion extending towards the body and is adapted to contact a lower inner edge area of the body to define the lowermost vertical position for the throat guard; the throat guard further includes an outwardly projecting portion adapted to contact the lower edge area of the body to define an uppermost vertical position for the throat guard.

In one form of the invention, the pivotal movement of the throat guard relative to the main body of the mask is achieved by a pair of pins which, in addition to hingedly connect the throat guard to the main body of the face mask, will also enable the quick engagement to and disengagement of the throat guard from the face mask.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIG. 2 is an enlarged cross-sectional view taken along lines 2—2 of FIG. 1 showing the throat guard in its lowermost position;

FIG. 3 is an enlarged cross-sectional view similar to FIG. 2 showing the throat guard in its uppermost position; and FIG. 4 is a cross-sectional view taken along line 4—4 of FIG. 3.

DESCRIPTION OF PREFERRED EMBODIMENTS

Figure 1:
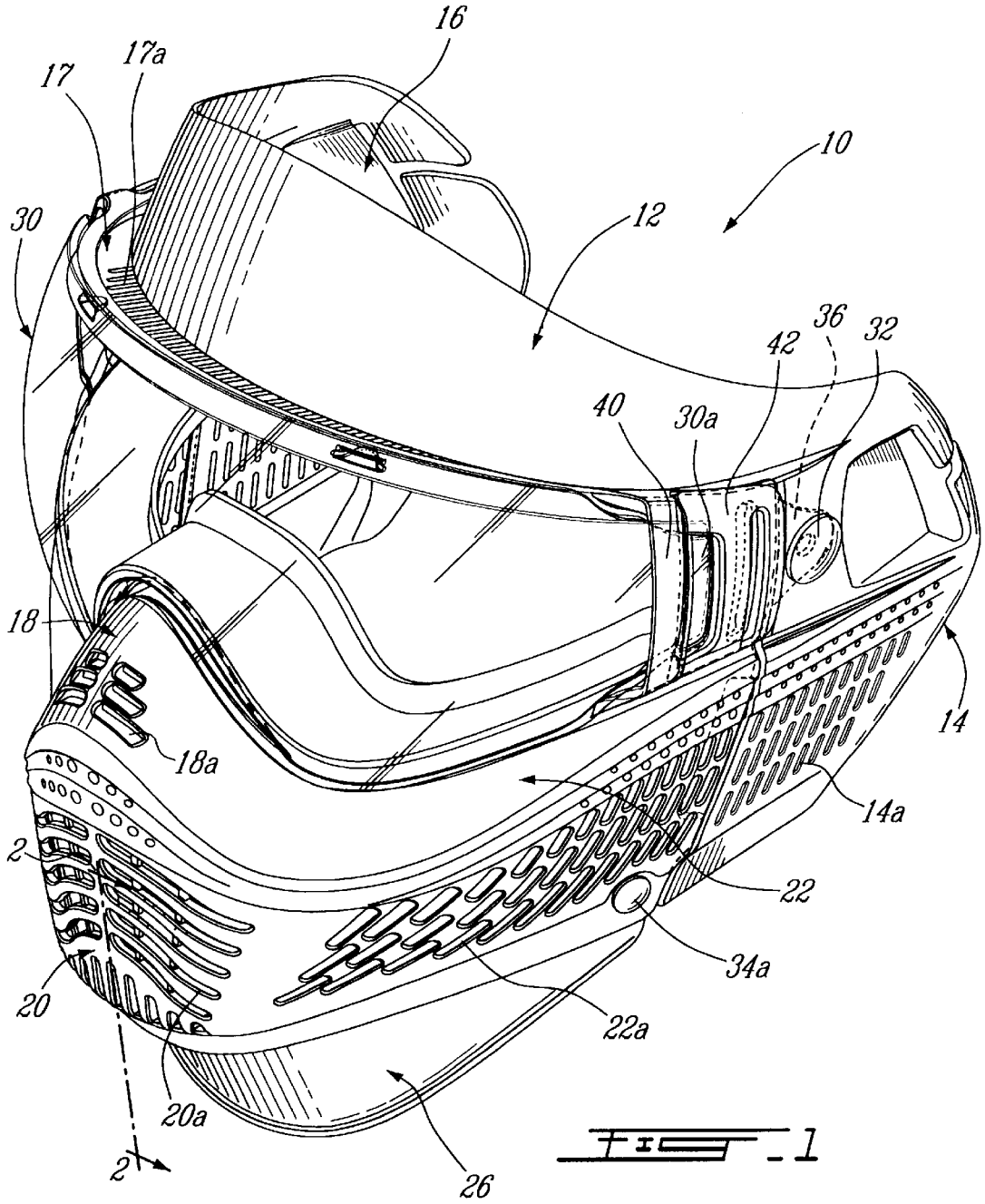
FIG. 1 is a perspective view of a protective mask made in accordance with the present invention.

Referring to FIG. 1, there is shown a protective mask, generally denoted 10, made in accordance with the present invention. The mask comprises a main body made of rigid plastic material that includes a first part consisting of a brow portion 12 integral with a pair of opposite side temple portions 14 and 16, and a second part consisting of a lens receiving portion 17, a nose portion 18, a chin portion 20 and opposite cheek portions 22. The lens receiving, nose, chin and cheek portions are provided with a series of openings 17*a*, 18*a*, 20*a* and 22*a* to provide ventilation for the user's face. Similar ventilation openings 14*a* are provided on the side temple portions 14 and 16 and, although not shown, could also be provided on the brow portion 12.

A throat guard 26 is shown mounted to the lower part of the mask body.

A transparent flexible plastic lens 30 covers the opening formed in the lens receiving portion 17 of the mask which extends between the brow portion 12, the nose portion 18 and the cheek portions 22.

A pair of pins 32 and 34 is provided on each side of the mask to secure the first part of the mask to the second part. More particularly, and referring also to FIG. 2, the lens receiving portion 17 has a pair of side extensions 36 that lies behind the side temple portions 14 and 16 and are provided with holes to receive pins 32. Similarly, the lower edge of each temple portion 14 has a frontwardly extending portion 14*b* (see FIG. 4) that lies behind the cheek portions 22 and is provided with a hole to receive pin 34.

The lens receiving portion 17 displays a pair of opposite vertically extending bridge portions 40 which serve to retain the opposite side extremities 30*a* of the lens. An anchor clamp 42 is provided to secure the inter-engagement of the lens extremities 30*a* to the bridge portions 40. A detailed description of this clamp construction does not form part of the present application; however, it does form part of a patent application filed concurrently herewith.

Referring to FIGS. 2 and 3, the throat guard 26 has a flared crescent-shaped body which is pivotally mounted with respect to the axis of both opposite pins 34. The lower edge 50 is outwardly curved. The upper edge of the throat guard has a tongue-like projection 52 which contacts a lip 54 of the inwardly curved lower edge area 56 of the chin portion 20 of the mask to thereby limit the lowermost pivotal position of the throat guard (FIG. 2). The lower edge 50 extends outwardly slightly beyond the vertical plane passing through the lower edge 56 of the chin portion of the mask to define the uppermost pivotal movement of the throat guard (FIG. 3).

Each pin 34 has a rounded head portion 34*a* and a split stem portion 34*b* defining two semi-circular segments 60 and 62, the outer contour of which is slightly greater than the circular holes extending through the throat guard 26, the temple portion 14 and the cheek portion 22. Thus, to insert pins 34 through the holes of the throat guard, the cheek portions 22 and the extensions 14*b,* segments 60 and 62 are inwardly flexed, and once engaged, they snap outwardly to provide engagement of the throat guard to the mask.

As shown in FIGS. 3 and 4, a strap 64 is provided with its extremities mounted to each pin 34 by means of a connecting element 66 which has, at one end thereof, an opening adapted to receive therein the split stem portion 34*b* of the pin in a manner similar to that described above for the throat guard.

Therefore, the removal of the strap as well as the throat guard can be easily effected by a simple snap-out movement of these two components of the face mask. Hence, the dimensions of the pin segments and their associated connecting parts are such as to enable such snap-in and snap-out without undue force.

Although the invention has been described above with respect with one specific form, it will be evident to a person skilled in the art that it may be modified and refined in various ways. It is therefore wished to have it understood that the present invention should not be limited in scope, except by the terms of the following claims.

What is claimed is:

1. A protective mask adapted to be worn by persons engaging in physical games comprising:

a main body formed of rigid plastic material including a nose portion, a chin portion, a brow portion, opposite cheek portions and opposite side temple portions to cover the front and sides of a person's head; said body displaying an opening between said brow portion and said nose and cheek portions;

a transparent lens mounted to said body and extending over said opening;

a removable throat guard pivotally mounted to said opposite cheek portions and inwardly of said chin and cheek portions; said throat guard being pivotable between two vertical positions relative to said chin and cheek portions; said throat guard having a tongue portion extending towards said main body and adapted to contact a lower edge area of said main body to define a lowermost vertical position for said throat guard; said throat guard further including a lower outwardly projecting area adapted to contact said lower edge area of said main body to define an uppermost vertical position for said throat guard;

a pair of opposite pins connecting said throat guard to said main body and allowing pivotal movement of said throat guard between said lowermost and uppermost positions; each said pin having a slotted portion shaped to enable a snap-in engagement and a snap-out disengagement of said throat guard to and from said main body; and a strap having its opposite ends freely connected to said pins.

2. A protective mask adapted to be worn by persons engaging in physical games comprising:

a main body formed of rigid plastic material including a nose portion, a chin portion, a brow portion, opposite cheek portions and opposite side temple portions to cover the front and sides of a person's head; said body displaying an opening between said brow portion and said nose and cheek portions;

a transparent lens mounted to said body and extending over said opening;

a throat guard pivotally mounted to said opposite cheek portions and inwardly of said chin and cheek portions; said throat guard being pivotable between two vertical positions relative to said chin and cheek portions; said throat guard having a tongue portion extending towards said main body and adapted to contact a lower edge area of said main body to define a lowermost vertical position for said throat guard; said throat guard further including a lower outwardly projecting area adapted to contact said lower edge area of said main body to define an uppermost vertical position for said throat guard;

a pair of opposite pins connecting said throat guard to said cheek portions and allowing pivotal movement of said throat guard between said lowermost and uppermost positions; and a strap having its opposite ends freely connected to said pins.

3. A protective mask adapted to be worn by persons engaging in physical games comprising:

a main body formed of rigid plastic material including a nose portion, a chin portion, a brow portion, opposite cheek portions and opposite side temple portions to cover the front and sides of a person's head; said body displaying an opening between said brow portion and said nose and cheek portions;

a transparent lens mounted to said body and extending over said opening;

a throat guard pivotally mounted to said opposite cheek portions and inwardly of said chin and cheek portions; said throat guard being pivotable between two vertical positions relative to said chin and cheek portions; said throat guard having a tongue portion extending towards said main body and adapted to contact a lower edge area of said main body to define a lowermost vertical position for said throat guard; said throat guard further including a lower outwardly projecting area adapted to contact said lower edge area of said main body to define an uppermost vertical position for said throat guard;

a pair of opposite pins connecting said throat guard to said cheek portions and allowing pivotal movement of said throat guard between said lowermost and uppermost positions; and a strap having its opposite ends freely connected to said pins; wherein each said pin has a slotted extremity shaped to enable a snap-in engagement of said throat guard and of said strap with the said main body.

* * * * *